US007895870B2

(12) United States Patent
Hayashi

(10) Patent No.: US 7,895,870 B2
(45) Date of Patent: Mar. 1, 2011

(54) METHOD FOR PRODUCING ULTRA THIN WALL METALLIC TUBE WITH COLD WORKING PROCESS

(75) Inventor: Chihiro Hayashi, Miyagi (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/984,588

(22) Filed: Nov. 20, 2007

(65) Prior Publication Data

US 2008/0148795 A1 Jun. 26, 2008

Related U.S. Application Data

(63) Continuation of application No. PCT/JP2006/310309, filed on May 24, 2006.

(30) Foreign Application Priority Data

May 27, 2005 (JP) ..... 2005-154797
Jun. 10, 2005 (JP) ..... 2005-171154

(51) Int. Cl.
*B21B 17/10* (2006.01)
*B21B 19/08* (2006.01)
*B21D 7/02* (2006.01)

(52) U.S. Cl. ..... 72/208; 72/96; 72/214

(58) Field of Classification Search ..... 72/208, 72/209, 283, 370.01, 370.14, 80, 84, 85, 72/95–97, 220, 189, 193, 197, 214, 252.5
See application file for complete search history.

(56) References Cited

U.S. PATENT DOCUMENTS 3,416,346 A * 12/1968 Arrington ..... 72/189
4,006,618 A * 2/1977 Yanagimoto et al. ..... 72/11.3
4,658,617 A 4/1987 Peytavin
4,866,968 A 9/1989 Cellier et al.
4,966,022 A * 10/1990 Stinnertz ..... 72/208
5,533,376 A * 7/1996 Wetzels et al. ..... 72/283
5,946,365 A 8/1999 Drillon et al.
6,718,811 B2 * 4/2004 Drillon et al. ..... 72/208

(Continued)

FOREIGN PATENT DOCUMENTS

JP 57-044429 3/1982

(Continued)

*Primary Examiner*—Dana Ross
*Assistant Examiner*—Teresa M Bonk
(74) *Attorney, Agent, or Firm*—Clark & Brody

(57) ABSTRACT

An exemplary embodiment of the invention provides a method for producing an ultra thin wall metallic tube by cold working method with significant wall thickness reduction. In a method for producing the metallic tube with a cold pilger mill according to the invention, cold rolling is performed while tube diameters are being expanded using rolls having tapered groove dies whose calibers increase from an engaging entry side toward a finishing exit side. In a method for producing the metallic tube with a drawing machine according to the invention, cold drawing is performed while the tube diameters are being expanded using a solid die whose calibers increase from an engaging entry side toward a finishing exit side and a plug of a tapered mandrel bar whose diameters increase from an entry side of the die toward an exit side. In the metallic tube producing method, a maximum diameter of the plug or tapered mandrel bar may be larger than an outside diameter of the mother tube.

3 Claims, 3 Drawing Sheets

U.S. PATENT DOCUMENTS 7,140,226 B2 * 11/2006 Wu ..... 72/370.06

FOREIGN PATENT DOCUMENTS

JP 61219418 9/1986
JP 01-192405 8/1989
JP 07-199507 8/1995
SU 432945 A 2/1979

* cited by examiner

METHOD FOR PRODUCING ULTRA THIN WALL METALLIC TUBE WITH COLD WORKING PROCESS

This application is a continuation of International Patent Application No. PCT/JP2006/310309, filed May 24, 2006. This PCT application was not in English as published under PCT Article 21(2).

TECHNICAL FIELD

The present invention relates to a method for cold-working a metallic tube, particularly to significant enlargement of a producible range on a thin wall side for the metallic tube and a method for producing an ultra thin wall metallic tube by the cold working process.

BACKGROUND ART

The metallic tube in a hot finishing state is delivered to a cold working process, when the metallic tube does not satisfy requirements in quality, strength, or dimensional accuracy. Generally, examples of the cold working process include a cold drawing process in which a die and a plug or a mandrel bar are used and a cold rolling process in which a cold pilger mill is used.

In the cold rolling process with the cold pilger mill, diameter reducing rolling is performed to a mother tube between a pair of rolls having a circumferentially-tapered groove die whose calibers are gradually reduced in a circumferential direction and a tapered mandrel bar whose diameters are gradually reduced toward its front end in a lengthwise direction. That is, the grooves are provided over the circumferences of the pair of rolls, and the grooves have such configuration that calibers of the grooves become narrowed as the rolls are rotated. The roll is repeatedly advanced and retreated along the tapered mandrel bar while rotated, whereby the rolling is performed to the mother tube between the rolls and the mandrel bar (for example, see "Iron and Steel Handbook third version" vol. 3, (2) Steel Bar, Steel Tube, and Rolling Common Facilities).

FIG. 1 is a view showing a rolling principle of the cold pilger mill, FIG. 1(*a*) is an explanatory view showing a start point of a forward stroke, and FIG. 1(*b*) is an explanatory view showing a start point of a backward stroke. As shown in FIG. 1, in the cold pilger mill, a pair of rolls 2 and a tapered mandrel bar 4 are used according to an outside diameter do and a wall thickness to of a mother tube 1 and an outside diameter d and a wall thickness t of a rolled tube 5 of a product. The roll 2 has a tapered groove die 3 whose calibers are gradually reduced from an engaging entry side of each of the pair of rolls toward a finishing exit side. The diameters of the tapered mandrel bar 4 are gradually reduced from the engaging entry side toward the finishing exit side. Forward and backward strokes in which the wall thickness is decreased while the diameter of the mother tube 1 is reduced are repeated.

At a start point of the forward stroke and a start point of the backward stroke in the reciprocating motion, a turn by about 60° and a feed ranging from about 5 to about 15 mm are intermittently imparted to the hollow-shell (mother tube 1), so that the rolling is performed on a new work area successively.

The cold rolling with the cold pilger mill is capable of applying an extremely high working rate to the hollow-shell, and tenfold elongation can be performed. Additionally, the cold rolling has a large effect on correcting an eccentricity of the wall thickness of tube, a further reducing process is not required, and the cold rolling features a high production yield. However, the cold rolling with the cold pilger mill has a disadvantage of extremely low productivity compared with the cold drawing process. Therefore, the cold rolling with the cold pilger mill is mainly suitable to cold working of high grade tubes, such as stainless tubes and high alloy steel tubes, in which raw materials and intermediate treatment costs are expensive. In a copper and copper alloy manufacturing industry, high-efficiency production is realized by three-strand rolling, and the cold pilger mill becomes a core production process for copper and copper alloy products.

In the cold drawing process, a tube end of the mother tube is swaged by a swaging machine, acid pickling is performed to remove a surface scale and the like, and lubricating treatment is performed to draw the mother tube through a die. Examples of the cold drawing process include plug drawing, drawing by using a floating plug, drawing by using a mandrel bar, and die drawing without a plug. All the cold drawing processes are performed by diameter reduction working with the die.

FIG. 3 is an explanatory view of the conventional drawing in which an outside diameter is reduced, FIG. 3(*a*) shows the plug drawing, and FIG. 3(*b*) shows drawing by using the mandrel bar.

The plug drawing shown in FIG. 3(*a*) is a most common drawing process. In the plug drawing, a plug 23 supported by a plug supporting rod 24 is inserted into the mother tube 1, the tube end of the mother tube 1 is gripped with a chuck 6, and the mother tube 1 is drawn through a die 22 in the direction shown by an arrow X of FIG. 3. The plug drawing has the advantages in plug exchange and operation efficiency, and the plug drawing also allows the substantial working rate.

The drawing by using the mandrel bar shown in FIG. 3(*b*) is a process in which a mandrel bar 25 is inserted into the mother tube 1 and the mother tube 1 is drawn through the die 22 like the plug drawing. In the drawing by using the mandrel bar, because the tube inner surface is processed by the mandrel bar 25, a product having a glossy inner surface can be produced with high dimensional accuracy even for the small diameter tube. Therefore, the drawing by using the mandrel bar is used in producing high grade tubes for use in a nuclear power plant and the like.

Most of drawing machines used in the cold drawing are driven by a motor with a chain, but some drawing machines are hydraulically-operated (either oil or water).

In the metallic-tube cold drawing process, there occurs frictional drag between the outer surface of the hollow-shell and the die surface and between the inner surface of the hollow-shell and the surface of the plug or mandrel bar, and the drawing is performed against the frictional drag. Therefore, tension is generated in a longitudinal direction of the hollow-shell. With the increase in tensile stress given by dividing the tension force by a post-drawing sectional area, a phenomenon that the tube outside diameter after drawing becomes smaller than the inside diameter of die is generated, and the in-processing tube breaks when the tensile stress reaches a deformation resistance of the hollow-shell. Obviously, as the wall thickness of the tube is thinned, the tensile stress is increased in a longitudinal direction and the tube becomes likely to break. Therefore, there is a limitation in a reduction rate of the wall thickness. Accordingly, in the drawing with the large reduction rate of the wall thickness, the number of drawing passes is increased and the repeated drawing operation is required, so that the lubricating work is required in each case to result in the cost increase. In the case that the large work hardening is generated in the hollow-shell, annealing process is also required.

DISCLOSURE OF THE INVENTION

In view of the foregoing, an object of the invention is to propose a method for producing an ultra thin wall metallic tube by a cold working process in which a producible range on the thin wall side of the metallic tube can significantly be enlarged. A thin wall seamless metallic tube is a main target of the invention, and a welded metallic tube is also included in the target of the invention because the uneven wall thickness is generated in a welded part or a heat affected zone and the correction thereof is sometimes required even in the thin wall welded metallic tube.

The inventor conducted research and development to solve the above problem based on the issues of the conventional art, and the inventor obtained the following findings to complete the invention.

Generally, in hollow-shell plastic working, the wall thickness reduction is achieved by elongating the hollow-shell in a longitudinal direction thereof. That is, in the hollow-shell cold rolling, in the case where the wall thickness working is performed between the groove roll and the tapered mandrel bar, the rolling is performed while the tube diameters are being reduced, and elongation in a longitudinal direction occurs.

In the hollow-shell cold drawing, in the case where the wall thickness working is performed between the die and the plug or mandrel bar, the drawing is performed while the diameters of the tube are being reduced, and elongation in a longitudinal direction occurs. Thus, because the hollow-shell is elongated only in a longitudinal direction, a reduction amount of wall thickness is restricted and it becomes difficult to produce the thinner wall thickness tube.

On the contrary, the inventor interpreted the above fact as meaning that the reduction amount of wall thickness is restricted and it becomes difficult to produce the thinner wall thickness tube because the hollow-shell is elongated only in a longitudinal direction when the plastic working is performed to the hollow-shell to reduce the wall thickness, and the inventor had an idea that the above problem could be avoided when the hollow-shell is elongated in a circumferential direction while the hollow-shell is elongated in a longitudinal direction in reducing the wall thickness of the hollow-shell with the cold pilger mill. When the case in which the rolling is performed to a ring shaped product with a ring rolling mill is studied as an extreme case, a ring shaped blank material is elongated not in a longitudinal direction (axial direction) but only in a circumferential direction of the ring, so that the wall thickness can infinitely be reduced.

In order to elongate the hollow-shell not only in a longitudinal direction but also in a circumferential direction in the cold pilger mill, it is necessary that the wall thickness be reduced to perform the elongating rolling while the diameters of the hollow-shell are being expanded using the tapered roll groove die whose calibers gradually increase from the engaging entry side of the roll toward the finishing exit side and the tapered mandrel bar whose diameters gradually increase from the engaging entry side toward the finishing exit side. In this case, the use of the tapered mandrel bar whose finishing maximum diameter larger than at least the outside diameter of the mother tube can surely expand the diameter of the mother tube.

In order to elongate the hollow-shell not only in a longitudinal direction but also in a circumferential direction in the drawing process, it is necessary that the drawing be performed while the diameters of the hollow-shell are being expanded using the plug or mandrel bar. The use of the plug or mandrel bar with a diameter, an inner-surface determining factor, larger than at least the outside diameter of the mother tube can surely expand the diameter of the mother tube.

As described above, when the drawing is performed while the diameters of the hollow-shell are being expanded, because a circumferential length in a circumferential direction is increased even if the wall thickness is thinned, the sectional area of the hollow-shell is not decreased too much, and advantageously the exerted tensile stress can be reduced during the drawing.

The invention is made based on the above findings, and the invention is summarized in a method for producing an ultra thin wall metallic tube by a cold working method shown in items (1) to (3).

(1) A method for producing an ultra thin wall metallic tube with a cold pilger mill, characterized in that a tube wall thickness is reduced to perform elongating rolling while tube diameters are being expanded by using a pair of rolls and a tapered mandrel bar according to outside diameters and wall thicknesses of a mother tube and a rolled tube product, the roll having a tapered groove die whose calibers gradually increase from an engaging entry side of the roll toward a finishing exit side of the roll, the diameters of the tapered mandrel bar being configured to gradually increase from an engaging entry side of the tapered mandrel bar toward a finishing exit side of the tapered mandrel bar.

(2) A method for producing an ultra thin wall metallic tube with a drawing machine, characterized by including: inserting a mother tube into a solid die, the mother tube being expanded at its one end, the solid die being configured such that calibers thereof gradually increase from an engaging entry side of the solid die toward a finishing exit side of the solid die; inserting a plug or a tapered mandrel bar into the mother tube, the plug or tapered mandrel bar being configured to gradually increase in diameter from the engaging entry side of the solid die toward the finishing exit side of the solid die; and drawing the mother tube from the engaging entry side toward the finishing exit side while the portion where the tube end is expanded is chucked, thereby reducing a wall thickness of the mother tube to perform elongation while a diameter of the mother tube is being expanded between the solid die and the plug or tapered mandrel bar.

(3) The ultra thin wall metallic tube producing method according to above mentioned (1) or (2), characterized in that a finishing maximum diameter of the plug or tapered mandrel bar is larger than an outside diameter of the mother tube. In the invention, "cold working process" shall mean a working process which the cold rolling process and the cold drawing process are collectively called.

BRIEF DESCRIPTION OF THE DRAWINGS

FIG. 2(*a*) shows the start point of the forward stroke, and FIG. 2(*b*) shows the start point of the backward stroke;

BEST MODE FOR CARRYING OUT THE INVENTION

As described above, the invention is a method for producing an ultra thin wall metallic tube by using the cold pilger mill or the cold drawing method. A first aspect according to the invention is a method for producing an ultra thin wall metallic tube with a cold pilger mill, the method characterized in that a tube wall thickness is reduced to perform elongating rolling while a tube diameter is being expanded by using a pair of rolls and a tapered mandrel bar according to outside diameters and wall thicknesses of a mother tube and a rolled tube product, the roll having a tapered groove die whose calibers gradually increase from an engaging entry side of the roll toward a finishing exit side of the roll, the tapered mandrel bar being gradually increased in diameter from an engaging entry side of the tapered mandrel bar toward a finishing exit side of the tapered mandrel bar.

Figure 1:
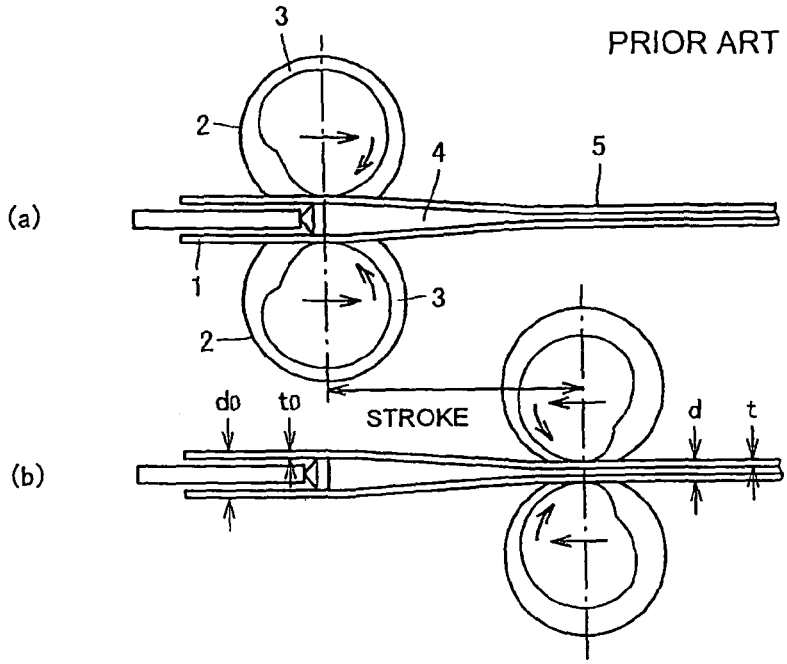
FIG. 1 is an explanatory view of conventional diameter reducing rolling, FIG. 1(*a*) shows a start point of a forward stroke, and FIG. 1(*b*) shows a start point of a backward stroke.
Figure 2:
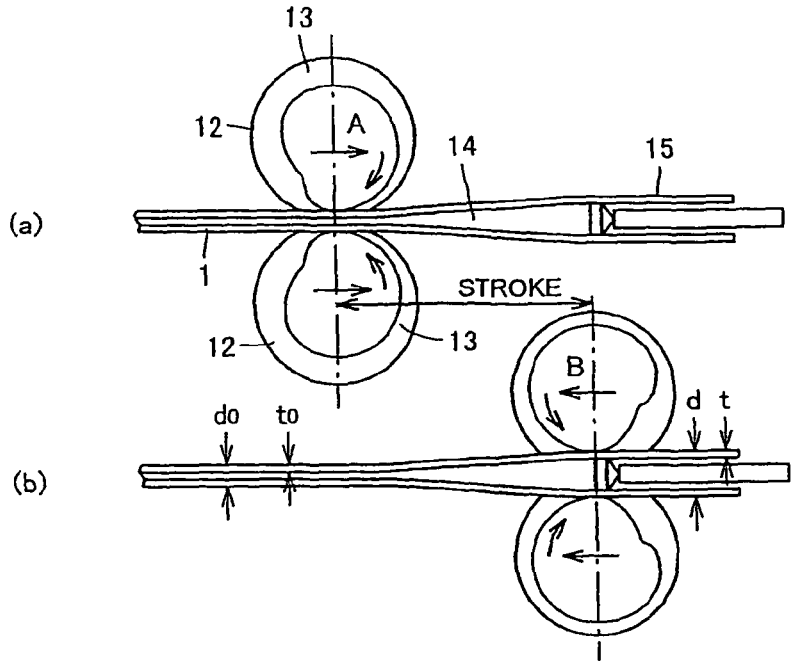
FIG. 2 is an explanatory view of diameter expansion rolling according to the invention.
Figure 3:
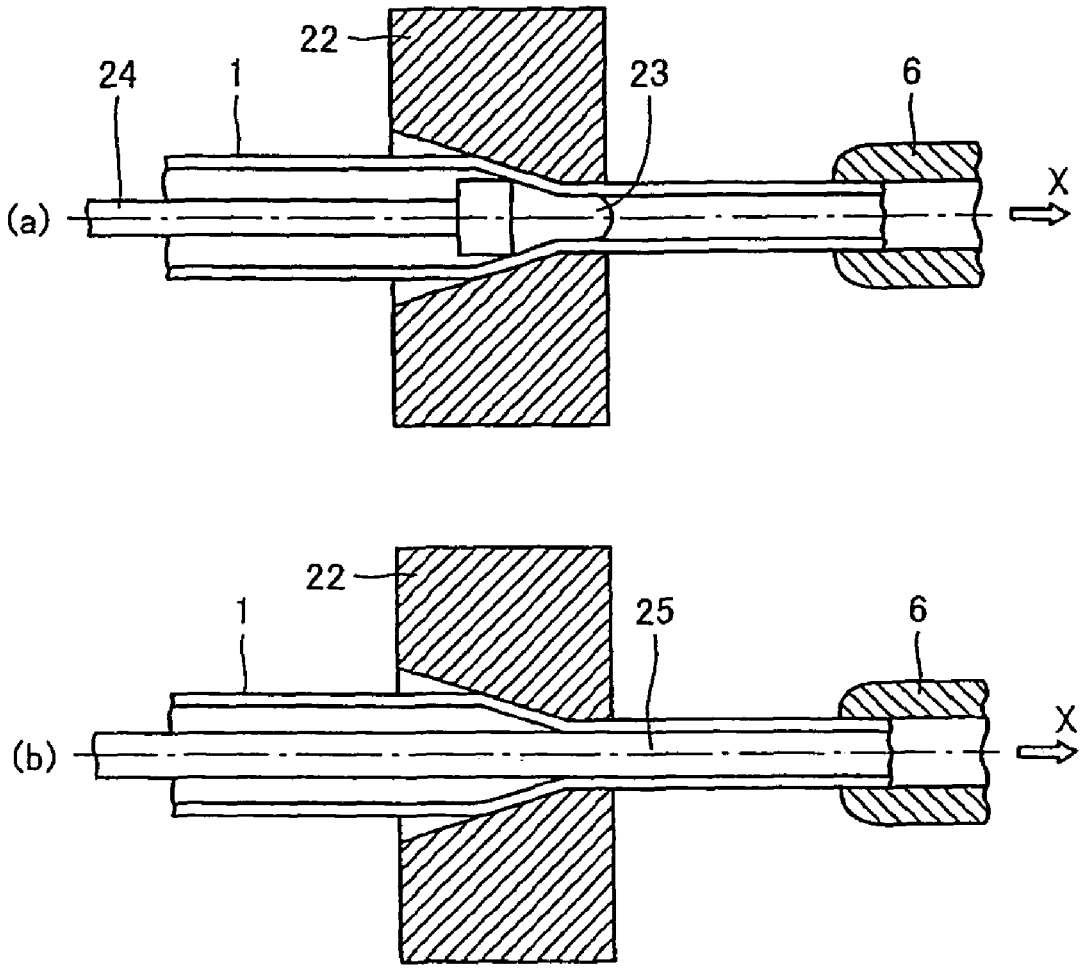
FIG.3 PRIOR ART
FIG. 3 is an explanatory view of conventional diameter reducing drawing, FIG. 3(*a*) shows plug drawing, and FIG. 3(*b*) shows drawing by using a mandrel bar.

FIG. 2 shows the first aspect according to the invention. FIG. 2(*a*) shows the start point of the forward stroke and FIG. 2(*b*) shows the start point of the backward stroke. As shown in FIG. 2(*a*), a tapered groove die 13 whose calibers smoothly increase from the engaging entry side toward the finishing exit side is provided over the circumference surface of each of a pair of rolls 12, and the pair of rolls 12 are advanced in the direction shown by an arrow A along a tapered mandrel bar 14 whose outside diameters smoothly increase from the engaging entry side toward the finishing exit side, whereby the elongating rolling is performed to a mother tube 1 between the working surface of the tapered groove die 13 of the roll 12 and the working surface of the tapered mandrel bar 14. Then, as shown in FIG. 2(*b*), the pair of rolls 12 are reversely rotated, and the elongating rolling is performed to the mother tube 1 between the tapered groove die 13 of the roll 12 and the tapered mandrel bar 14 while the pair of rolls 12 are retreated in the direction shown by an arrow B of FIG. 2.

By repetition of the forward and backward strokes, the mother tube 1 having an outside diameter do and a wall thickness to is rolled in a rolled tube product 15 having an outside diameter d and a wall thickness t while the diameter of the mother tube 1 is being expanded. In the start point of the forward stroke and the start point of the backward stroke in the reciprocating motion, the hollow-shell (mother tube 1) feeding and turning procedure to be applied is similar to the conventional art.

A second aspect according to the invention is a method for producing an ultra thin wall metallic tube with a drawing machine, the method characterized by including: inserting a mother tube into a solid die, the mother tube being expanded at its one end, the solid die being configured such that its calibers gradually increase from an engaging entry side of the solid die toward a finishing exit side of the solid die; inserting a plug or a tapered mandrel bar into the mother tube, the plug or tapered mandrel bar being configured to gradually increase in diameter from the engaging entry side of the solid die toward the finishing exit side of the solid die; and drawing the mother tube from the engaging entry side toward the finishing exit side while the portion where the tube end is expanded is chucked, thereby reducing a tube wall thickness to perform elongation while tube diameters are being expanded between the solid die and the plug or tapered mandrel bar.

In order to put the diameter expansion drawing of the hollow-shell in practical use, it is necessary that the operation of the cold drawing is changed as follows, compared with the conventional drawing.

First, the diameter at the tube end of the mother tube is expanded in a tapered manner by a tube-end expander. For example, a press expanding procedure may be used as the tube-end expander. Second, after acid pickling and lubricating treatment are performed to the mother tube whose tube end is expanded, the mother tube is introduced into the solid die from the finishing exit side of the solid die, and the mother tube is drawn while the diameter is being expanded between the solid die and the plug or tapered mandrel bar which has an inner surface regulating diameter larger than the outside diameter of the mother tube. Third, the plug or tapered mandrel bar is also supported on the finishing exit side of the die. Although ancillary facilities are closely concentrated on the finishing exit side of the die, there is a large advantage that the thin wall metallic tube can be drawn.

Figure 4:
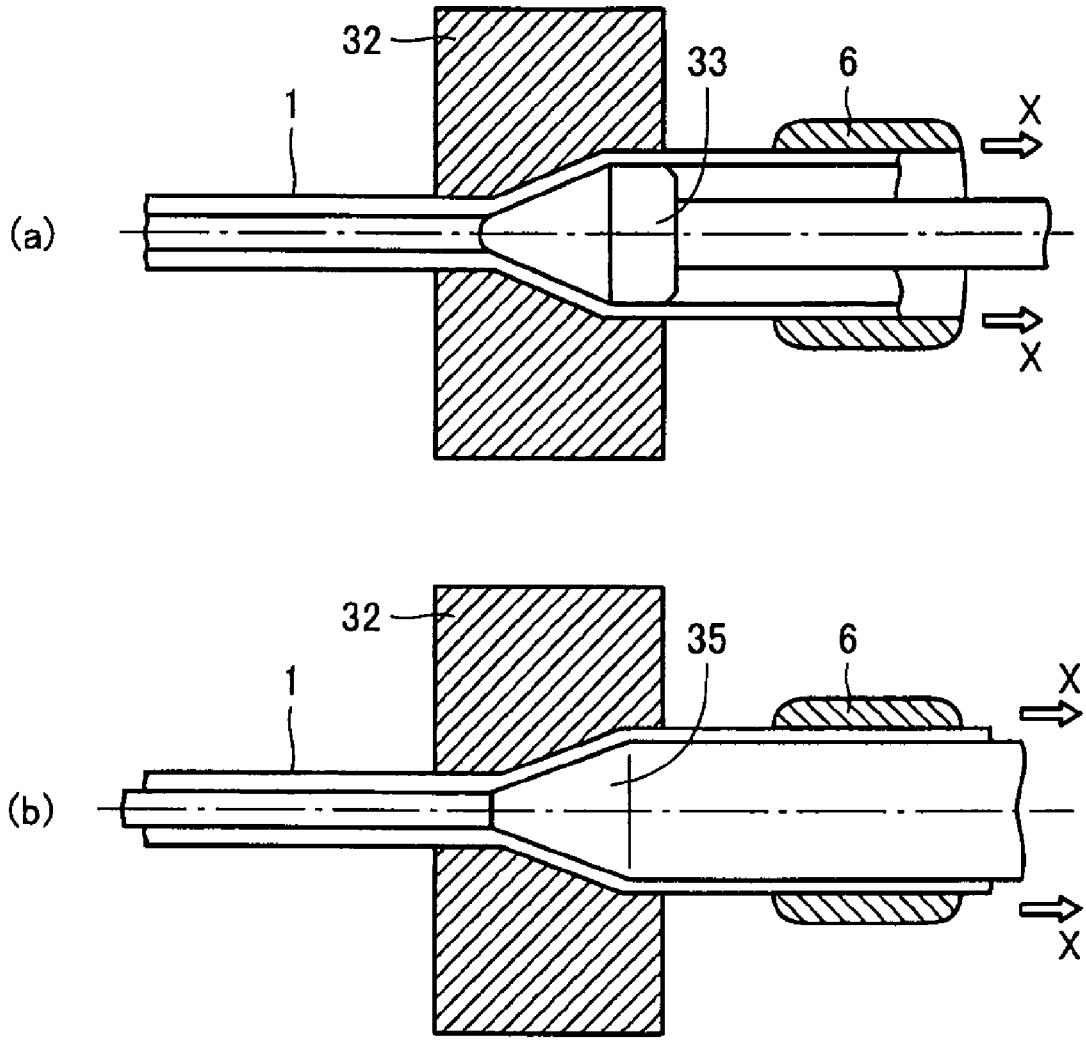
FIG. 4 is an explanatory view of diameter expansion drawing according to the invention, FIG. 4(*a*) shows plug drawing, and FIG. 4(*b*) shows drawing by using a mandrel bar.

FIG. 4 shows the second aspect according to the invention. FIG. 4(*a*) shows plug drawing and FIG. 4(*b*) shows drawing by using a mandrel bar. As shown in FIGS. 4(*a*) and 4(*b*), calibers of a solid die 32 increase from the engaging entry side of the die (left side of the solid die 32 of FIG. 4) toward the finishing exit side (right side of the solid die 32 of FIG. 4), and the mother tube 1 whose tube end is expanded is inserted into the solid die 32 from the finishing exit side of the solid die 32. A plug 33 or a tapered mandrel bar 35 is inserted into the mother tube 1. The diameters of the plug 33 or tapered mandrel bar 35 increase from the entry side of the solid die 32 toward the exit side, and a finishing maximum diameter the plug 33 or tapered mandrel bar 35 is larger than the outside diameter of the mother tube 1. Then, the mother tube 1 is drawn in the direction shown by an arrow X of FIG. 4 while the expanded tube end of the mother tube 1 is gripped with the chuck 6. Through the operation, the mother tube 1 is drawn while the diameter of the mother tube 1 is being expanded between the solid die 32 and the plug 33 or tapered mandrel bar 35.

EXAMPLE

The following tests were performed and the results were evaluated in order to confirm the effects of the ultra thin wall metallic tube producing methods by the cold rolling process and the cold drawing process according to the invention. Because the action and effect of the drawing by using mandrel bar are substantially equal to those of the plug drawing, the plug drawing will be described in the examples.

Example 1

A 18% Cr-8% Ni stainless tube having the outside diameter of 34.0 mm and the wall thickness of 3.5 mm produced by the Mannesmann-mandrel mill process was used as the mother tube for test specimen, the mother tube was rolled while the diameter was expanded by the cold pilger mill, and the obtained tube had the outside diameter of 50.8 mm and the wall thickness of 1.3 mm. The test conditions and results are summarized as follows.

Diameter of tapered mandrel bar: dm ranging from 26.0 to 47.2 mm

Feed: f=10.0 mm

Turn angle: $\theta=60°$

Mother tube outside diameter: do=34.0 mm

Mother tube wall thickness: to =3.5 mm

Outside diameter of tube after rolling: $d_1$=50.8 mm

Wall thickness of tube after rolling: $t_1$=1.3 mm

Expansion ratio of diameter: $d_1/do=1.49$

Elongation ratio: $to(do-to)/\{t_1(d_1-t_1)\}=1.66$ (Wall thickness/Outside diameter) Ratio: $t_1/d_1=2.56\%$ The tube obtained by the above test had glossy inner and outer surface textures, and there was no particular issue in quality. In the cold rolling performed by the conventional diameter reducing rolling, the producible minimum wall thickness is about 2.0 mm is in the 18% Cr-8% Ni stainless tube having the outside diameter of 50.8 mm. Therefore, it is clear that the diameter expansion drawing of the invention has the significant advantage.

Example 2

A 18% Cr-8% Ni stainless tube having the outside diameter of 34.0 mm and the wall thickness of 3.5 mm produced by the Mannesmann-mandrel mill process was used as the mother tube for test specimen, the mother tube was processed while the diameter was expanded by the cold drawing process, and the obtained tube had the outside diameter of 50.8 mm and the wall thickness of 1.6 mm.

The test conditions and results are summarized as follows.

Plug diameter: dp=47.5 mm

Mother tube outside diameter: do=34.0 mm

Mother tube wall thickness: to=3.5 mm

Outside diameter of tube after drawing: $d_1$=50.8 mm

Wall thickness of tube after drawing: $t_1$=1.6 mm

Expansion ratio of diameter: $d_1/do$=1.49

Elongation ratio: $to(do-to)/\{t_1(d_1-t_1)\}$=1.36

(Wall thickness/Outside diameter) Ratio: $t_1/d_1$=3.15%

The tube obtained by the above test had glossy inner and outer surface textures, and there was no particular issue in quality. In the 18% Cr-8% Ni stainless tube having the outside diameter of 50.8 mm, because the minimum wall thickness is about 2.4 mm by the conventional diameter reducing drawing, it is clear that the diameter expansion drawing of the invention has the significant advantage.

INDUSTRIAL APPLICABILITY

The use of the ultra thin wall metallic tube producing method by the cold working process of the invention can significantly enlarge the producible range on the thin wall side of the metallic tube by the cold working method. When the seamless metallic tube having the wall thickness less than about two-thirds of the conventional cold-finishing seamless metallic tube is economically stably produced by the method of the invention, thin wall welded metallic tubes such as a TIG welded tube and a laser welded tube can be replaced with the high-reliability ultra thin wall seamless metallic tube produced by the method of the invention. When the ultra thin wall seamless metallic tube having the wall thickness not more than 0.6 mm is stably produced, the ultra thin wall seamless metallic tube can be applied to high-technology fields such as a heating sleeve of a color laser printer, a pressurizing roll of the color laser printer, and a cell case of a fuel cell.

The invention claimed is:

1. A method for producing an ultra thin wall metallic tube from a mother tube by employing a cold pilger mill, that permits elongation rolling in both forward and backward strokes, the method comprising:

reducing tube wall thickness to perform elongating rolling in both forward and backward strokes while tube diameters are being expanded by using a pair of rolls and a tapered mandrel bar, each roll having a tapered groove die whose calibers gradually increase from an engaging entry side of the roll toward a finishing exit side of the roll, the tapered mandrel bar being configured such that its diameters gradually increase from an engaging entry side of the tapered mandrel bar toward a finishing exit side of the tapered mandrel bar.

2. The ultra thin wall metallic tube producing method according to claim 1, wherein a finishing maximum diameter of the tapered mandrel bar is larger than an outside diameter of the mother tube.

3. The method of claim 1, wherein the metallic tube is a stainless steel tube or a high alloy steel tube.

* * * * *